US010126049B2

(12) United States Patent
Shah

(10) Patent No.: US 10,126,049 B2
(45) Date of Patent: Nov. 13, 2018

(54) METHOD AND APPARATUS FOR REMOVING BENZENE CONTAMINANTS FROM NATURAL GAS

(71) Applicant: IHI E&C International Corporation, Houston, TX (US)

(72) Inventor: Kamal Shah, Sugar Land, TX (US)

(73) Assignee: IHI E&C International Corporation, Houston, TX (US)

( * ) Notice: Subject to any disclaimer, the term of this patent is extended or adjusted under 35 U.S.C. 154(b) by 293 days.

(21) Appl. No.: 15/048,291

(22) Filed: Feb. 19, 2016

(65) Prior Publication Data

US 2016/0245587 A1 Aug. 25, 2016

Related U.S. Application Data

(60) Provisional application No. 62/120,075, filed on Feb. 24, 2015.

(51) Int. Cl.

| | |
|---|---|
| ***F25J 3/08*** | (2006.01) |
| ***F25J 3/02*** | (2006.01) |
| ***C10L 3/10*** | (2006.01) |

(52) U.S. Cl.

CPC ..... *F25J 3/0209* (2013.01); *C10L 3/10* (2013.01); *F25J 3/0233* (2013.01); *F25J 3/0238* (2013.01); *F25J 3/0247* (2013.01); *F25J 2200/02* (2013.01); *F25J 2200/70* (2013.01); *F25J 2200/74* (2013.01); *F25J 2205/04* (2013.01); *F25J 2205/50* (2013.01); *F25J 2210/04* (2013.01); *F25J 2220/60* (2013.01); *F25J 2240/02* (2013.01); *F25J 2245/02* (2013.01)

(58) Field of Classification Search

CPC .. F25J 3/08; F25J 3/0209; F25J 3/0233; F25J 3/0247; F25J 2210/06; F25J 2200/07; F25J 2200/74; F25J 2205/50; F25J 2220/60; F25J 2245/02; F25J 2210/04; F25J 2240/02

See application file for complete search history.

(56) References Cited

U.S. PATENT DOCUMENTS

| | | | | |
|---|---|---|---|---|
| 4,278,457 | A | 7/1981 | Campbell et al. | |
| 2004/0177646 | A1 * | 9/2004 | Wilkinson ..... | F25J 1/0201 62/614 |
| 2004/0200353 | A1 | 10/2004 | Bras et al. | |

FOREIGN PATENT DOCUMENTS

| | | | |
|---|---|---|---|
| DE | 102 05 366 | A1 | 8/2003 |
| DE | 10 2004 046342 | A1 | 3/2006 |
| DE | 10 2012 020354 | A1 | 4/2014 |

OTHER PUBLICATIONS

Notification of Transmittal of the International Search Report and The Written Opinion of the International Searching Authority, or the Declaration cited in PCT/US2016/018726, dated Jun. 23, 2016, 17 pages.

* cited by examiner

*Primary Examiner* — Brian King
(74) *Attorney, Agent, or Firm* — Blank Rome LLP

(57) ABSTRACT

A method and apparatus for removing benzene from a lean natural gas feed is provided. The method and apparatus are capable of removing benzene from lean natural gas that is predominantly composed of methane and contains very little heavier hydrocarbon components.

8 Claims, 4 Drawing Sheets

Related Process

Related Process

Related Process

Modified Process

METHOD AND APPARATUS FOR REMOVING BENZENE CONTAMINANTS FROM NATURAL GAS

CROSS-REFERENCE TO RELATED APPLICATIONS

The present invention claims benefit of U.S. Provisional Patent Application No. 62/120,075, filed on Feb. 24, 2015, all of which is incorporated herein by reference in its entirety for all purposes.

FIELD OF THE DISCLOSURE

This invention relates to the field of liquefied natural gas (LNG) gas conditioning processes, and in particular to the removal of benzene from the feed to the LNG production/liquefaction facility of a very lean natural gas containing trace (small) amounts of benzene.

BACKGROUND

Traces of benzene in lean natural gas, having no or very small amounts of liquefied petroleum gas (LPG) and/or heavier components in the lean gas, can freeze in the gas liquefaction units operating at sub cryogenic temperatures, if the benzene is not removed from the feed to the gas liquefaction to less than 1 part per million (ppm) level. Natural gas in general and liquefied natural gas (LNG) in particular, is usually comprised mostly of methane ($C_1$). Natural gas may also, however, contain lesser amounts of heavier hydrocarbons such as ethane ($C_2$), propane ($C_3$), butanes ($C_4$) and the like, which are collectively known as $C_{2+}$, or ethane plus. Hydrocarbons heavier than ethane are collectively known as $C_{3+}$, or C3 plus, or propane plus. Removal of the small amounts of benzene from a very lean methane rich natural gas using a cryogenic process such as Gas Sub-cooled Process (GSP) operating at high pressure or other similar cryogenic expander based process is also difficult due to the absence of adequate amount of heavier LPG components ($C_3$, iso-$C_4$, n-$C_4$, pentanes, etc.) in the feed gas to the gas liquefaction process. Small amounts of benzene are difficult to condense and remove from the lean feed gas having high methane content (over 97% methane, especially in the absence of adequate amounts of heavier ($C_3$ plus) components).

The process for removing benzene to a very low level (less than 1 ppm) in absence of adequate amount of $C_3$ plus components in the natural gas liquid (NGL) is described herein. Conventional cryogenic expander processes can normally remove NGL components as well as heavier components, including benzene, to a level of less than 1 ppm benzene to avoid freeze up in the natural gas liquefaction units only when sufficient heavier hydrocarbons are present in the gas mixture. These conventional cryogenic expander processes cannot economically and/or efficiently remove benzene in the absence of adequate LPG ($C_3$, and/or $C_4$ plus) components because the traces of benzene cannot be condensed at high operating pressure and thereby cannot be easily removed. In these instances, the gas from the overhead of the demethanizer (DeC1) going to the liquefaction will carry over benzene to a higher than 1 ppm level to the gas liquefaction section, where the lack of solubility of benzene in the LNG (methane) will cause freezing in the sub-cryogenic sections of the liquefaction process.

The inventive process and apparatus solve the problem described above through modification to a related design and operation at relatively higher pressure to remove the benzene to less than 1 ppm from lean natural gas containing very small amount of benzene in the absence of adequate LPG ($C_3$, and/or $C_4$ plus) components. The embodiments of the present invention described herein thereby provide economic and energy efficient methods and apparatuses to remove benzene from gaseous feeds to the liquefaction unit lacking adequate amounts of $C_3$, and/or $C_4$ plus components.

SUMMARY

The following presents a simplified summary in order to provide a basic understanding of some aspects described herein. This summary is not an extensive overview of the claimed subject matter. It is intended to neither identify key or critical elements of the claimed subject matter nor delineate the scope thereof. Its sole purpose is to present some concepts in a simplified form as a prelude to the more detailed description that is presented later.

In accordance with one embodiment, a method for removing benzene from a lean natural gas feed comprises splitting a dehydrated feed gas into a first input stream directed into a rich/lean gas exchanger to provide a first output stream and a second input stream directed into a demethanizer side re-boiler to provide a second output stream, feeding the first output stream from the rich/lean gas exchanger into a expander suction drum, feeding the second output stream into an expander suction drum, splitting the gaseous output stream from the expander suction drum into a first expander output stream, a second expander suction drum output stream, and a third expander suction drum condensate output stream, feeding the first expander suction drum output stream into a demethanizer column reflux exchanger to produce an exchanged gas stream and feeding the exchanged gas stream into a demethanizer column, feeding the second expander output stream into a gas expander to produce an expanded gas and feeding the expanded gas into the demethanizer column, feeding the third expander suction drum output stream into the demethanizer column, condensing the gas in the demethanizer column to form a NGL (natural gas liquid) condensate, feeding the NGL condensate from the bottom into a stabilizer inlet cooler and subsequently into a stabilizer, directing a gas stream from the stabilizer into a stabilizer condenser to provide a first condensate, feeding the first condensate into a stabilizer reflux drum to form a first stabilized condensate, providing a solvent makeup stream comprising a formulated hydrocarbon based solution containing a majority of components lighter than hexane and heavier than butane, providing a solvent storage tank for the formulated hydrocarbon based solution, pumping the formulated hydrocarbon based solution with one or more solvent make up pumps into a liquid stream comprising the first stabilized condensate to form a combined liquid stream, feeding the combined liquid stream into one or more NGL reinjection pumps, solvent recycle pumps, or a combination thereof to form a solvent recycle stream; and feeding the solvent recycle stream back into the dehydrated gas feed.

In a second aspect, an apparatus for removing benzene from a natural gas feed comprises a rich/lean gas exchanger, a demethanizer side re-boiler, an expander suction drum, a demethanizer reflux exchanger, a demethanizer unit and a first NGL condensate stream, a stabilizer inlet cooler receiving the NGL condensate stream, a stabilizer, a plurality of stabilizer reflux pumps, a stabilizer condenser, a stabilizer reflux drum, a solvent storage tank for storing a formulated hydrocarbon based solution containing a majority of components lighter than hexane and heavier than butane, a plurality of solvent makeup pumps for pumping the formulated hydrocarbon based solution, and a plurality of NGL reinjection pumps, solvent recycle pumps, or a combination thereof.

Other features and characteristics of the subject matter of this disclosure, as well as the methods of operation, functions of related elements of structure and the combination of parts, and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
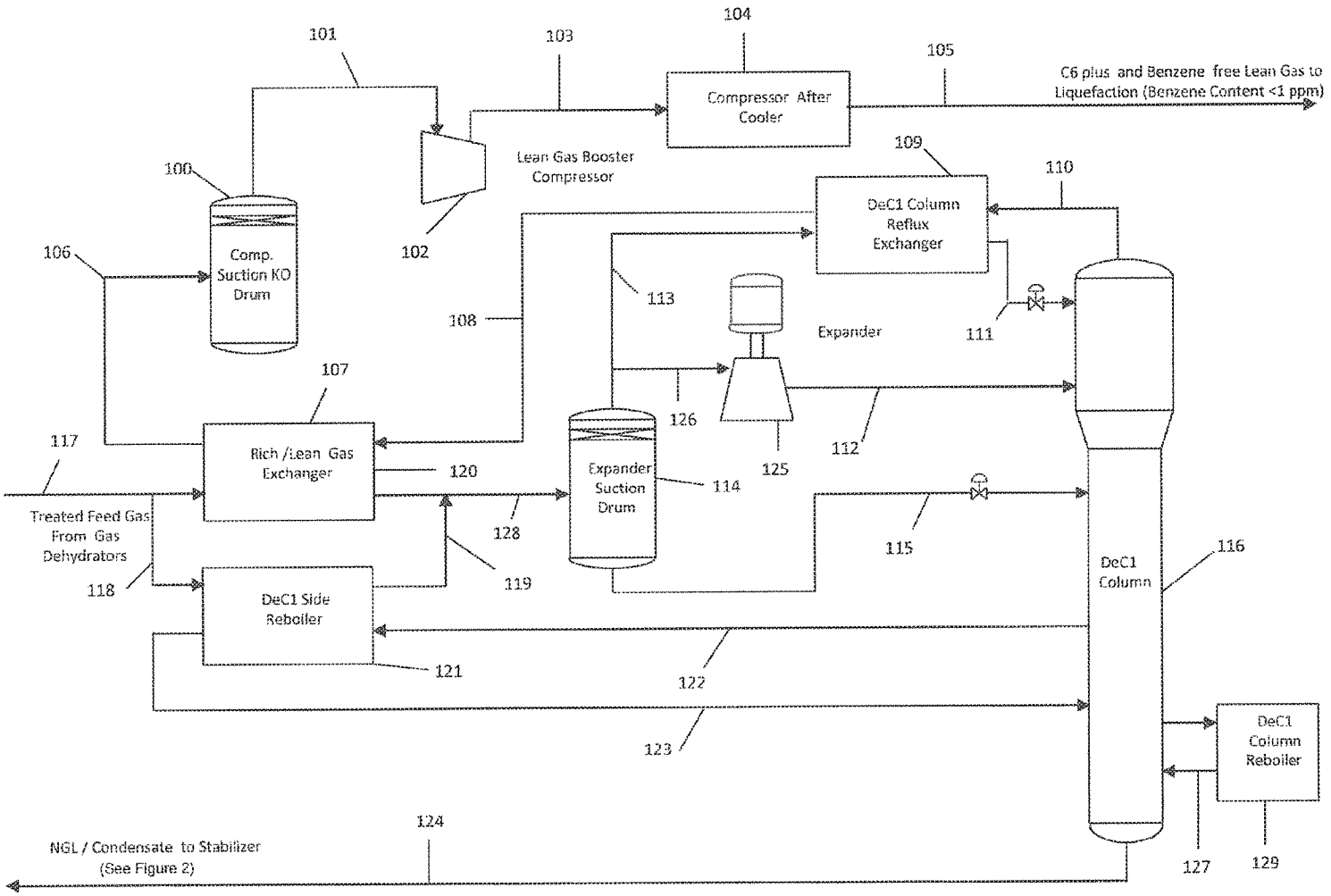
FIG. 1 is a schematic diagram of a first part of a benzene removal process according to a related art.

While aspects of the subject matter of the present disclosure may be embodied in a variety of forms, the following description and accompanying drawings are merely intended to disclose some of these forms as specific examples of the subject matter. Accordingly, the subject matter of this disclosure is not intended to be limited to the forms or embodiments so described and illustrated.

Unless defined otherwise, all terms of art, notations and other technical terms or terminology used herein have the same meaning as is commonly understood by one of ordinary skill in the art to which this disclosure belongs. All patents, applications, published applications and other publications referred to herein are incorporated by reference in their entirety. If a definition set forth in this section is contrary to or otherwise inconsistent with a definition set forth in the patents, applications, published applications, and other publications that are herein incorporated by reference, the definition set forth in this section prevails over the definition that is incorporated herein by reference.

Unless otherwise indicated or the context suggests otherwise, as used herein, "a" or "an" means "at least one" or "one or more."

This description may use relative spatial and/or orientation terms in describing the position and/or orientation of a component, apparatus, location, feature, or a portion thereof. Unless specifically stated, or otherwise dictated by the context of the description, such terms, including, without limitation, top, bottom, above, below, under, on top of, upper, lower, left of, right of, in front of, behind, next to, adjacent, between, horizontal, vertical, diagonal, longitudinal, transverse, radial, axial, etc., are used for convenience in referring to such component, apparatus, location, feature, or a portion thereof in the drawings and are not intended to be limiting.

Furthermore, unless otherwise stated, any specific dimensions mentioned in this description are merely representative of an exemplary implementation of a device embodying aspects of the disclosure and are not intended to be limiting.

In FIG. 1 is shown a first portion of an existing process for removing benzene from the feed gas to the gas liquefaction unit. A gas feed 117 comprises a warm treated feed gas source from a gas dehydrator unit. The gas feed 117 can also be split into feed 118 and directed into a demethanizer side re-boiler 121. The cold gas feed 119 from re-boiler 121 can be directed into gas feed 128. Part of the gas feed from the treated feed gas source 117 can be directed into a rich/lean gas exchanger 107. The cooled feed gas from the exchanger 107 is combined with stream 119 to form stream 128 and fed to the expander suction drum 114. The warm benzene free gas stream 106 from the rich/lean gas exchanger 107 can be directed into compressor-suction knock-out drum (KO drum) 100. Gas feed 101 from the KO drum can be directed into lean gas booster compressor 102, and subsequently the benzene free compressed gas stream 103 can be directed into compressor after cooler 104. The output gas stream 105 from compressor 104 can be fed into a gas liquefying apparatus.

The cold gas feed 128 from exchangers 107 and 121 can be directed into expander suction drum 114 and, from which gas feeds can be split into streams 113 and 126 can be directed into a demethanizer column reflux exchanger 109 and into the expander 125, respectively. The third condensate liquid stream 115 from the expander suction drum 114 contains a controllable valve that operably controls the feed stream entering column 116. Gas feed 112 from expander 125 can be directed into column 116. Exchanger 109 receive cold benzene free lean gas stream 110 from the demethanizer overhead and feed to the exchanger 109 and the output gas stream 108 from exchanger 109 feed back into exchanger 107. The condensed liquid feed 111 from exchanger 109 can be fed into column 116. Feed stream 111 contains condensed liquid and a controllable valve that operably controls the stream entering column 116. The cold liquid feed 122 from the middle of the column 116 can be fed into re-boiler 121. Additionally, the warmer gas/liquid feed 123 from re-boiler 121 and can be returned back to column 116. Column 116 also has a connected demethanizer column re-boiler 129 that is capable of receiving demethanizer bottom liquid and return heated gas/liquid feed 127 back to the column 116. The reboiler 329 can be supplied with the external heat source to reboil the demethanizer bottom liquid.

Figure 2:
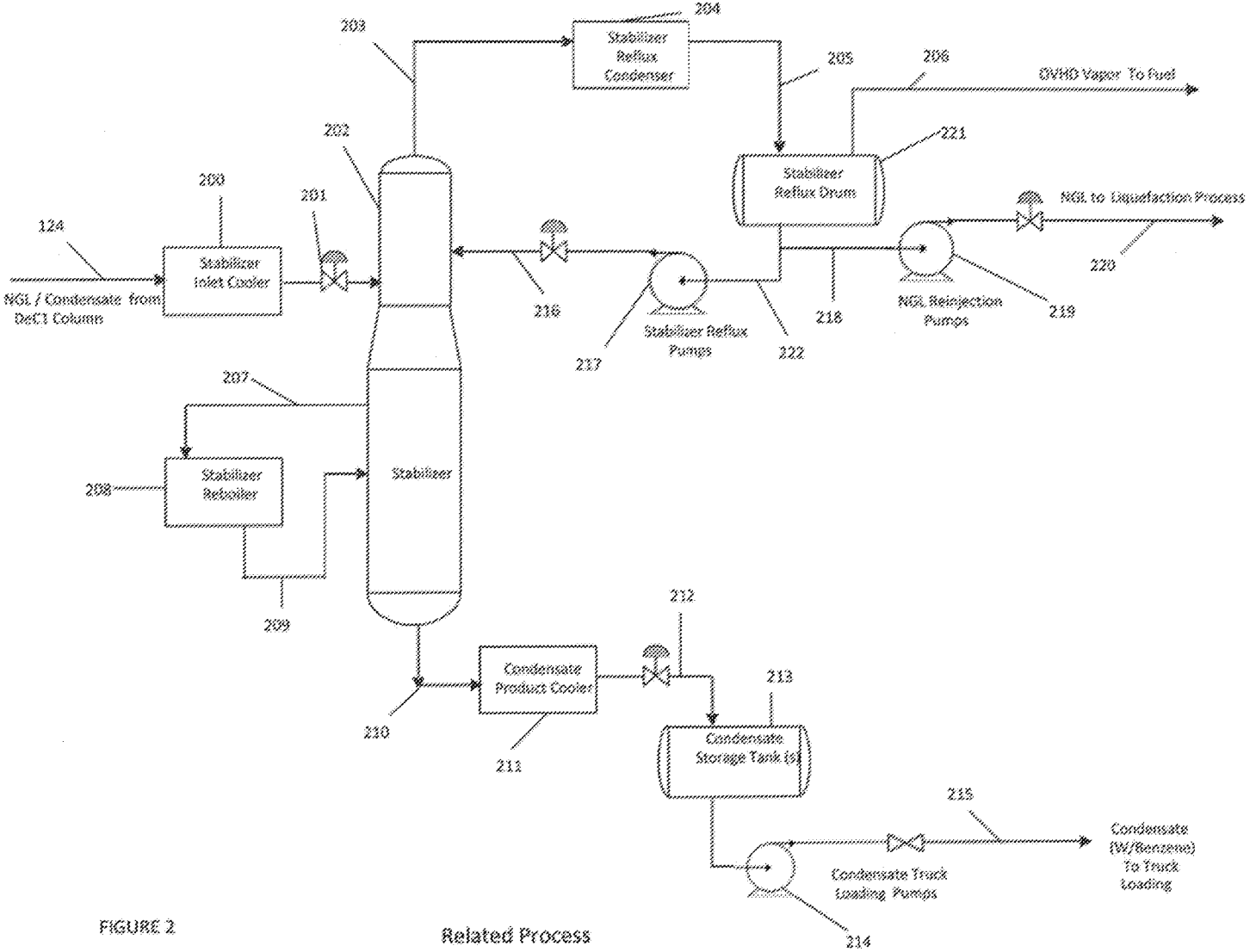
FIG. 2 is a schematic diagram of a second part of a benzene removal process according to a related art.

In FIG. 2 is shown a second portion of an existing process from removing benzene from the feed to the LNG production or gas liquefier. Column bottom 116 feeds an NGL/condensate stream 124 through a stabilizer inlet cooler 200. Liquid stream 201 from inlet cooler 200 feeds into stabilizer 202. Liquid feed 201 contains a controllable valve that operably controls the liquid stream entering stabilizer column 202. External heat source provides heat to the reboiler 208. Stabilizer re-boiler 208 receives liquid feed 207 from stabilizer 202 and re-feeds heated gas/liquid stream 209 back into stabilizer 202. Gas feed 203 from stabilizer 202 overhead can be directed into stabilizer reflux condenser 204, and the condensed liquid and non-condensable gas stream 205 from condenser 204 can be directed into stabilizer reflux drum 221. The non-condensable overhead gas stream 206 separated in reflux drum 221 can be directed as overhead vapor to the plant fuel. The condensed liquid stream 222 separated in reflux drum 221 can be directed into a plurality of stabilizer reflux pumps 217, which are operably connected together, and back into stabilizer 202 providing reflux to the column through liquid feed 216. Liquid feed 216 contains a controllable valve that operably controls the stream entering stabilizer 202. The remaining liquid feed 218, directed from feed 222, can be directed into NGL reinjection pumps 219. The NGL stream 220 from reinjection pumps 219 can be fed into a further liquefaction process.

The bottom hot liquid condensate containing benzene stream 210 from stabilizer 202 can be directed into condensate product cooler 211, and then via liquid feed 212 into condensate storage tank(s) 213. The condensate from storage tank(s) 213 can be fed into condensate truck loading pumps 214, and via liquid feed 215 from loading pumps 214, the condensate containing benzene can be directed into trucks for loading.

In one embodiment, the inventive process comprises treating a lean natural gas, which contains benzene impurities and very small amounts of $C_2$, $C_3$, and/or $C_4$ plus components.

Figure 3:
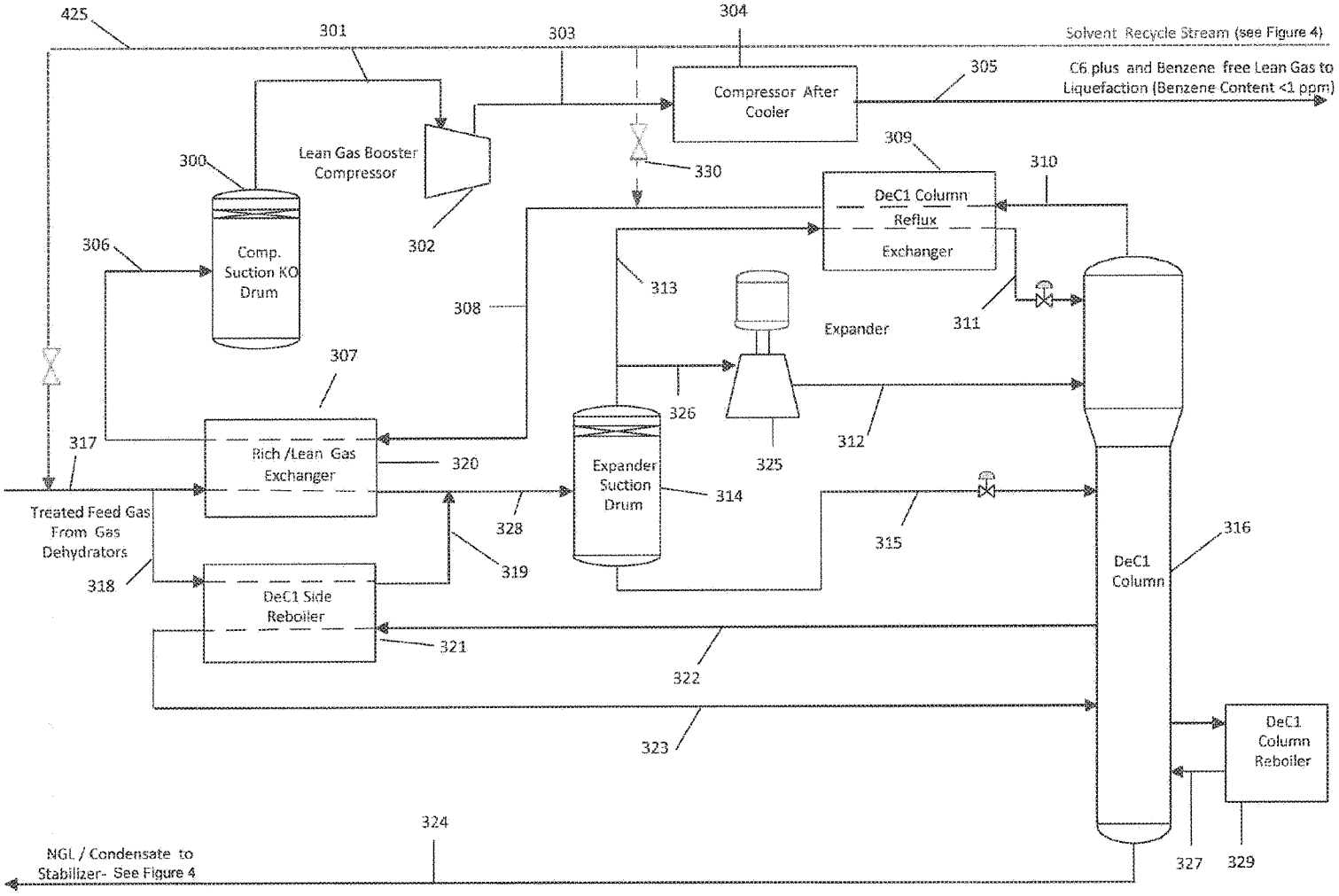
FIG. 3 is a schematic diagram of a first part of a benzene removal process according to one embodiment of the invention.

In FIG. 3 is shown a first portion of an embodiment of the inventive process for removing benzene contaminants from feed to the LNG production or gas liquefaction. A gas inlet feed 317 comprises a warm treated feed gas source from a gas dehydrator unit. The gas feed 317 can also be split into feed 318 and directed into a demethanizer side re-boiler 321. The cold gas feed 319 from re-boiler 321 can be directed into gas feed 328. Part of the gas feed from the treated gas feed source 317 can be directed into a rich/lean gas exchanger 307. The cooled feed gas from the exchanger 307 is combined with stream 319 to form stream 328 and fed to the expander suction drum 314. The warm benzene free gas stream 306 from lean/rich exchanger 307 can be directed into compressor-suction knock-out drum (KO drum) 300. Gas feed 301 from the KO drum can be directed into lean gas booster compressor 302, and subsequently the benzene free compressed gas stream 303 can be directed into compressor after cooler 304. The output gas stream 305 from compressor 304 can be fed into a gas liquefying apparatus.

The cold gas feed 328 from exchangers 307 and 321 can be directed into expander suction drum 314 and, from which gas feeds can be split into streams 313 and 326 can be directed into a demethanizer column reflux exchanger 309 and expander 325, respectively. The third condensate liquid stream 315 from the expander suction drum 314 contains a controllable valve that operably controls the gas stream entering column 316. The gas feed 312 from expander 325 can be directed into column 316. Exchanger 309 receive cold benzene free lean gas stream 310 from the demethanizer overhead and feed to the exchanger 309 and the output gas stream 308 from exchanger 309 feed back into exchanger 307. Gas feed 311 from exchanger 309 can be fed into column 316. Gas feed 311 contains condensed liquid and a controllable valve that operably controls the stream entering column 316. The cold liquid feed 322 from the middle of the column 316 can be fed into re-boiler 321. Additionally, the warmer gas/liquid feed 323 from re-boiler 321 can be returned back to column 316. Column 316 also has a connected demethanizer column re-boiler 329 that is capable of receiving demethanizer bottom liquid and return back heated gas/liquid feed 327 back to the column 316. The reboiler 329 can be supplied with the external heat source to reboil the demethanized bottom liquid. In one embodiment, a solvent recycle stream 425 is fed back into gas inlet feed 317. In some embodiments, stream 425 containing solvent can be diverted into stream 313 through valve and feed 330, upstream of the exchanger 309.

Figure 4:
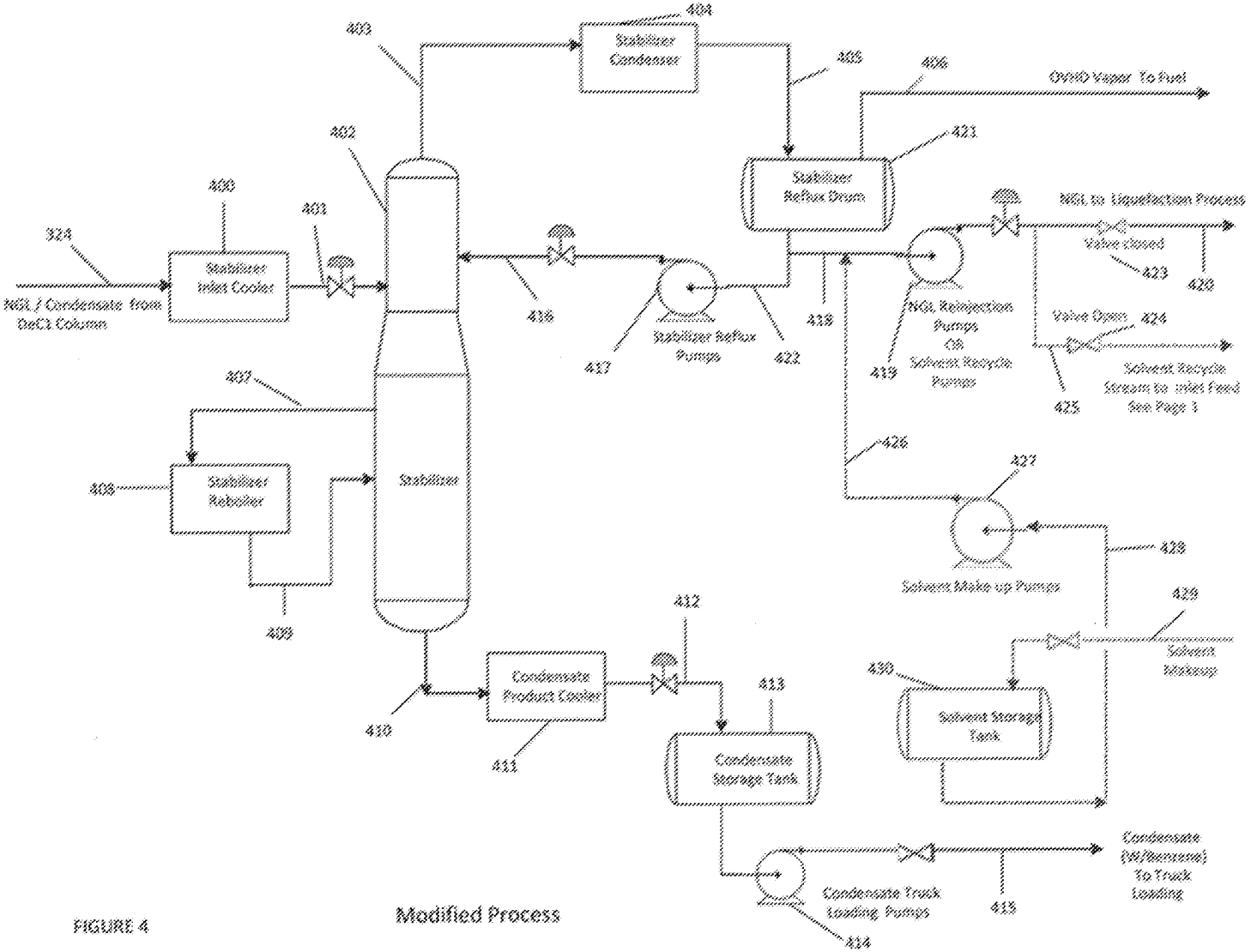
FIG. 4 is a schematic diagram of a second part of a benzene removal process according to one embodiment of the invention.

In FIG. 4 is shown a second portion of an embodiment of the inventive process for removing benzene from the feed gas to the LNG production or gas liquefier. Column bottoms from 316 feed an NGL/condensate stream 324 through a stabilizer inlet cooler 400. Liquid stream 401 from inlet cooler 400 feeds into stabilizer 402. Liquid feed 401 contains a controllable valve that operably controls the liquid stream entering stabilizer 402. Stabilizer re-boiler 408 receives liquid feed 407 from stabilizer 402 and re-feeds heated gas/liquid stream 409 back into stabilizer 402. The external heat source provides heat to the reboiler 408. Gas feed 403 from stabilizer 402 overhead can be directed into stabilizer reflux condenser 404, and the condensed liquid and non-condensable gas stream 405 from condenser 404 can directed into stabilizer reflux drum 421. The non-condensable overhead gas stream 406 separated in reflux drum 421 can be directed to the plant fuel. The condensed liquid stream 422 separated from reflux drum 421 can be directed into a plurality of stabilizer reflux pumps 417, which are operably connected together, and back into stabilizer 402 providing reflux to the column through liquid feed 416. Liquid feed 416 contains a controllable valve that operably controls the stream entering stabilizer 402. The remaining liquid feed 418, directed from liquid feed 422, can be directed into NGL reinjection pumps 419. In some embodiments, the NGL reinjection pumps 419 are instead solvent recycle pumps. In some embodiments, the 419 pumps are an operational combination of solvent recycle pumps and NGL reinjection pumps. The NGL stream 420 from reinjection pumps 419 can be fed into a further liquefaction process when there is no benzene present in stream 420. The NGL stream 420 contains valve 423 that may be opened or closed. When valve 423 is closed, no NGL is fed into a liquefaction process.

In one embodiment, valve 423 is closed and the liquid stream 425 is fed back into gas inlet 317. The liquid stream 425 contains valve 424, which can be opened or closed. When the liquid is fed back into gas inlet 317, valve 424 is in the open position and valve 423 is in closed position. In one embodiment, solvent makeup stream 429 is imported and directed into solvent storage tank 430. Solvent stream 429 contains a controllable valve that can be opened or closed. Solvent stream 428 from storage tank 430 can be directed into solvent makeup pumps 427, and then through solvent feed 426 from makeup pumps 427 into solvent recycle pumps 419.

The bottom hot liquid condensate containing benzene stream 410 from stabilizer 402 can be directed into condensate product cooler 411, and then via liquid feed 412 into condensate storage tank 413. The condensate from storage tank 413 can be fed into condensate truck loading pumps 414, and via liquid feed 415 from loading pumps 414, the condensate containing benzene can be directed into trucks for loading.

In some embodiments, the solvent in solvent stream 429 is specifically formulated to minimize make-up and purge and it is separated and recycled back to the process. The solvent is a formulated hydrocarbon based solution containing majority of components lighter than hexane and heavier than butane. In some embodiments, the solvent can contain at least 50%, 60%, 70%, 80%, 90%, 95%, or 99% by weight or by volume, or any range in between, of hydrocarbons having molecular weights less than hexane ($C_6H_{14}$) and greater than butane ($C_4H_{10}$). In some embodiments, the solvent in solvent stream 429 and/or in solvent storage tank 430 is specially formulated and can comprise a mixture of n-pentane, iso-pentane (2-methylbutane), and neo-pentane (2,2-dimethylpropane), or a mixture of any of the foregoing pentane isomers. In some embodiments, the solvent in solvent stream 429 and/or in solvent storage tank 430 can comprise less than 100000 ppm, 10000 ppm, 5000 ppm, 1000 ppm, 500 ppm, 100 ppm, 50 ppm, 25 ppm, 10 ppm, 5 ppm, or 1 ppm, or any range in between these values, of heavier components ($C_6$ hydrocarbons or heavier) as contaminants.

In some embodiments, the solvent in solvent stream 429 and/or in solvent storage tank 430 can comprise 80%, 90%, 95%, 98%, or 99% by weight or by volume, or any range in between these values, of n-pentane, iso-pentane, or neo-pentane. If the solvent adventitiously contains small amounts of hexane or other $C_6$ hydrocarbons, the hexane or other $C_6$ hydrocarbons will be purged along with benzene as part of the condensate. In some embodiments, the method of operation helps remove small amount of benzene from the lean natural gas feed when insufficient amount of LPG components are present. In some embodiments, the total amount of $C_2$ plus, $C_3$ plus, and/or $C_4$ plus components in the natural gas feed stream is less than 100000 ppm, 10000 ppm, 5000 ppm, 1000 ppm, 500 ppm, 100 ppm, 50 ppm, 25 ppm, 10 ppm, 5 ppm, or 1 ppm, or any range in between these values.

In some embodiments, gas inlet feed 317 comprises natural gas containing at least 97%, 97.5%, 98%, 98.5%, 99%, or 99.5% by weight or by volume, or any range in between these values, of methane. In some embodiments, the NGL feed 420 comprises <1 ppm, <0.5 ppm, <0.25 ppm, <0.1 ppm, <0.05 ppm, <0.01 ppm, <0.005 ppm, less than <0.001 ppm, or any range in between these values, of benzene. The terms "benzene free," "no benzene," and the like, as used throughout the specification, can refer to benzene amounts comprising <1 ppm, <0.5 ppm, <0.25 ppm, <0.1 ppm, <0.05 ppm, <0.01 ppm, <0.005 ppm, less than <0.001 ppm, or any range in between these values, of benzene.

In one embodiment, an apparatus for removing small amounts of benzene from a lean natural gas feed when insufficient amount of LPG components are present, is provided. The apparatus is depicted schematically in FIG. 3 and FIG. 4 together. The apparatus comprises gas feed 317, gas feed 318, re-boiler 321, gas feed 319, gas feed 328, rich/lean gas exchanger 307, gas feed 306, compressor-suction knock-out drum (KO drum) 300, gas feed 301, lean gas booster compressor 302, gas stream 303, compressor after cooler 304, output gas stream 305.

The apparatus further comprises gas feed 328, exchanger 307, expander suction drum 314, gas feeds 313 and 326, demethanizer column reflux exchanger 309, demethanizer column 316, condensed liquid feed 315, expander 325, gas feed 312, condensed liquid feed 311, liquid feed 322, re-boiler 321, gas/liquid feed 323, demethanizer column re-boiler 328, gas/liquid feed 327, and solvent recycle stream 425.

The apparatus further comprises an NGL/condensate stream 324, stabilizer inlet cooler 400, liquid stream 401, stabilizer 402, liquid feed 416, stabilizer re-boiler 408, liquid feed 407, gas feed 403, stabilizer reflux condenser 404, stabilizer reflux drum 421, gas/condensed liquid feed 405, liquid feed 422, a plurality of stabilizer reflux pumps 417, liquid feed 418, NGL reinjection pumps 419. In some embodiments, the NGL reinjection pumps 419 are instead solvent recycle pumps. In some embodiments, the pumps 419 are an operational combination of solvent recycle pumps and NGL reinjection pumps. The apparatus further comprises NGL stream 420, valve 423, liquid stream 425, valve 424, solvent makeup stream 429, one or more solvent storage tanks 430, solvent stream 428, a plurality of solvent makeup pumps 427, solvent feed 426, and a plurality of solvent recycle pumps 419.

The operational parameters of apparatus components 300-329, 400-418, and 420, such as pressure, temperature, flow rate, and the like, are readily ascertained and/or known to those of ordinary skill in the art.

While the subject matter of this disclosure has been described and shown in considerable detail with reference to certain illustrative embodiments, including various combinations and sub-combinations of features, those skilled in the art will readily appreciate other embodiments and variations and modifications thereof as encompassed within the scope of the present disclosure. Moreover, the descriptions of such embodiments, combinations, and sub-combinations is not intended to convey that the claimed subject matter requires features or combinations of features other than those expressly recited in the claims. Accordingly, the scope of this disclosure is intended to include all modifications and variations encompassed within the spirit and scope of the following appended claims.

The invention claimed is:

1. A method for removing benzene from a lean natural gas feed containing benzene, the method comprising:

splitting a dehydrated feed gas into a first input stream directed into a rich/lean gas exchanger to provide a first output stream and a second input stream directed into a demethanizer side re-boiler to provide a second output stream;

feeding the first output stream from the rich/lean gas exchanger into a expander suction drum;

feeding the second output stream into the expander suction drum;

splitting a gaseous output stream from the expander suction drum into a first expander suction drum output stream, a second expander suction drum output stream, and a third expander suction drum condensate output stream;

feeding the first expander suction drum output stream into a demethanizer column reflux exchanger to produce an exchanged gas stream and feeding the exchanged gas stream into a demethanizer column;

feeding the second expander output stream into a gas expander to produce an expanded gas and feeding the expanded gas into the demethanizer column;

feeding the third expander suction drum condensate output stream into the demethanizer column;

condensing the exchanged gas stream and the expanded gas in the demethanizer column to form a NGL (natural gas liquid) condensate;

feeding the NGL condensate from a bottom of the demethanizer column into a stabilizer inlet cooler and subsequently into a stabilizer;

directing a gas stream from the stabilizer into a stabilizer condenser to provide a first condensate;

feeding the first condensate into a stabilizer reflux drum to form a first stabilized condensate;

providing a solvent makeup stream comprising a formulated hydrocarbon based solution containing a majority of hydrocarbon components lighter than hexane and heavier than butane;

providing a solvent storage tank for the formulated hydrocarbon based solution;

pumping the formulated hydrocarbon based solution with one or more solvent make up pumps into a liquid stream comprising the first stabilized condensate to form a combined liquid stream;

feeding the combined liquid stream into one or more NGL reinjection pumps, solvent recycle pumps, or a combination thereof to form a solvent recycle stream; and feeding the solvent recycle stream back into the dehydrated gas feed.

2. The method of claim 1, wherein the formulated hydrocarbon based solution contains between 50% and 99% by weight of hydrocarbons lighter than hexane and heavier than butane.

3. The method of claim 1, wherein a total amount of $C_2$ plus, $C_3$ plus, and/or $C_4$ plus components in the lean natural gas feed is between 1000 ppm and 1 ppm.

4. The method of claim 1 further comprising outputting a lean gas stream from an overhead of the demethanizer, wherein the lean gas stream contains from less than 1 ppm of benzene to 0.001 ppm of benzene.

5. An apparatus for removing benzene from a natural gas feed containing benzene, comprising:

a rich/lean gas exchanger configured for receiving a first input stream from the natural gas feed and producing a first output stream;

a demethanizer side re-boiler configured for receiving a second input stream from the natural gas feed and producing a second output stream;

an expander suction drum configured for receiving the first and second output streams and producing a gaseous output stream comprising at least a first expander suction drum output stream;

a demethanizer reflux exchanger configured for receiving the first expander suction drum output stream from the expander suction drum and producing an exchanged gas stream;

a demethanizer unit configured for receiving the exchanged gas stream from the demethanizer reflux exchanger and condensing the exchanged gas stream to form a first NGL condensate stream;

a stabilizer inlet cooler configured for receiving the first NGL condensate stream from the demethanizer unit and producing a liquid feed stream;

a stabilizer configured for receiving the liquid feed stream from the stabilizer inlet cooler and producing a gas stream;

a stabilizer condenser configured for receiving the gas stream from the stabilizer and producing a first condensate;

a stabilizer reflux drum configured for receiving the first condensate from the stabilizer condenser and producing a first stabilized condensate;

a solvent storage tank configured for storing a formulated hydrocarbon based solution containing a majority of hydrocarbon components lighter than hexane and heavier than butane;

a plurality of solvent makeup pumps configured for pumping the formulated hydrocarbon based solution into a liquid stream comprising the first stabilized condensate to form a combined liquid stream; and a plurality of NGL reinjection pumps, solvent recycle pumps, or a combination thereof configured for receiving the combined liquid stream from the plurality of solvent makeup pumps and forming a solvent recycle stream.

6. The apparatus of claim 5, wherein the formulated hydrocarbon based solution contains between 50% and 99% by weight of hydrocarbons lighter than hexane and heavier than butane.

7. The apparatus of claim 5, wherein a total amount of $C_2$ plus, $C_3$ plus, and/or $C_4$ plus components in the natural gas feed is between 1000 ppm and 1 ppm.

8. The apparatus of claim 5, wherein the demethanizer unit comprises an overhead and is configured for outputting a lean gas stream from the overhead, wherein the lean gas stream contains from less than 1 ppm of benzene to 0.001 ppm of benzene.

* * * * *